United States Patent [19]

Ricord

[11] Patent Number: 4,457,288

[45] Date of Patent: Jul. 3, 1984

[54] CAM LEVER COMPOUND BOW

[76] Inventor: Michael R. Ricord, 3217½ S. West St., Stillwater, Okla. 74074

[21] Appl. No.: 411,067

[22] Filed: Aug. 24, 1982

[51] Int. Cl.[3] ..... F41B 5/00

[52] U.S. Cl. ..... 124/23 R; 124/88

[58] Field of Search ..... 124/DIG. 1, 23 R, 24 R, 124/16, 26, 27, 41 A, 88

[56] References Cited

U.S. PATENT DOCUMENTS

| | | | |
|---|---|---|---|
| 3,674,001 | 7/1972 | Hitt | 124/88 X |
| 3,744,473 | 7/1973 | Nishioka | 124/24 R |
| 4,244,345 | 1/1981 | Simo et al. | 124/24 R |
| 4,287,867 | 9/1981 | Islas | 124/24 R |

*Primary Examiner*—Richard J. Apley
*Assistant Examiner*—William R. Browne
*Attorney, Agent, or Firm*—Robert K. Rhea

[57] ABSTRACT

In an archery bow having a rigid handle portion and a pair of non-flexing limbs connected with the respective ends thereof, a pair of cams are mounted at the respective ends of the handle portion. The respective ends of the bowstring are connected with the cams and entrained over pulleys at the free ends of the limbs. Resilient members, secured to the handle portion, bear against the camming surface of the cams. As the bowstring is drawn, the cams force the resilient members toward the respective ends of the handle portion and stop the bowstring at full draw at the limit of cam rotation against the resilient members.

5 Claims, 2 Drawing Figures

CAM LEVER COMPOUND BOW

BACKGROUND OF THE INVENTION

1. Field of the Invention.

The present invention relates to archery bows and more particularly to a compound bow tending to produce a reduced draw weight at the maximum bowstring displacement.

2. Description of the Prior Art.

Several prior art patents disclose force reduction at maximum bow displacement which generally incorporate eccentric cams in conjunction with a plurality of tensioning cables and pulleys which reduces the bowstring weight at or near its maximum displacement. Since these prior art bows are generally complex in construction and operation by requiring interaction with pairs of devices connected with the bow ends they have not come into general use.

This invention provides a simplified cam and pulley arrangement in which a pair of cams, secured to the respective ends of the bowstring, are rotated against resilient members so that the full force of bowstring draw is imparted to the arrow upon release of the bowstring from maximum draw.

SUMMARY OF THE INVENTION

A bow frame is provided with a pair of rigid limbs projecting arcuately from respective ends of its handle portion toward the direction of bowstring displacement. A pair of eccentric cams are mounted, by brackets, at respective ends of the handle portion. A pair of resilient spring members, secured, at one end, to respective end portions of the handle portion, frictionally contact, at their other ends, the camming surface of the respective cam. Each of the cams are provided with an integral pulley coaxial with the axis of the cam mounting to which the respective ends of the bowstring are secured with the bowstring entrained, at its respective end portions, over a pair of pulleys secured to the free ends of the limbs so that when the bowstring is drawn the eccentric surface of the cams are rotated against the respective end portions of the resilient members which move toward the respective ends of the handle. An outwardly projecting stop on each cam contacts the free end of the respective resilient member to stop the drawstring movement at full draw and simultaneously reduces the bowstring weight at full draw.

The principal objects of the invention are to provide a rigid compound bow utilizing eccentric cams mounted on the bow and connected with respective ends of the bowstring which bear against bow frame mounted resilient members movable by the cams toward the bow frame in which a stop on the cams limit bowstring displacement and tend to reduce the bowstring draw weight at its position of maximum displacement.

DESCRIPTION OF THE PREFERRED EMBODIMENT

Figure 1:
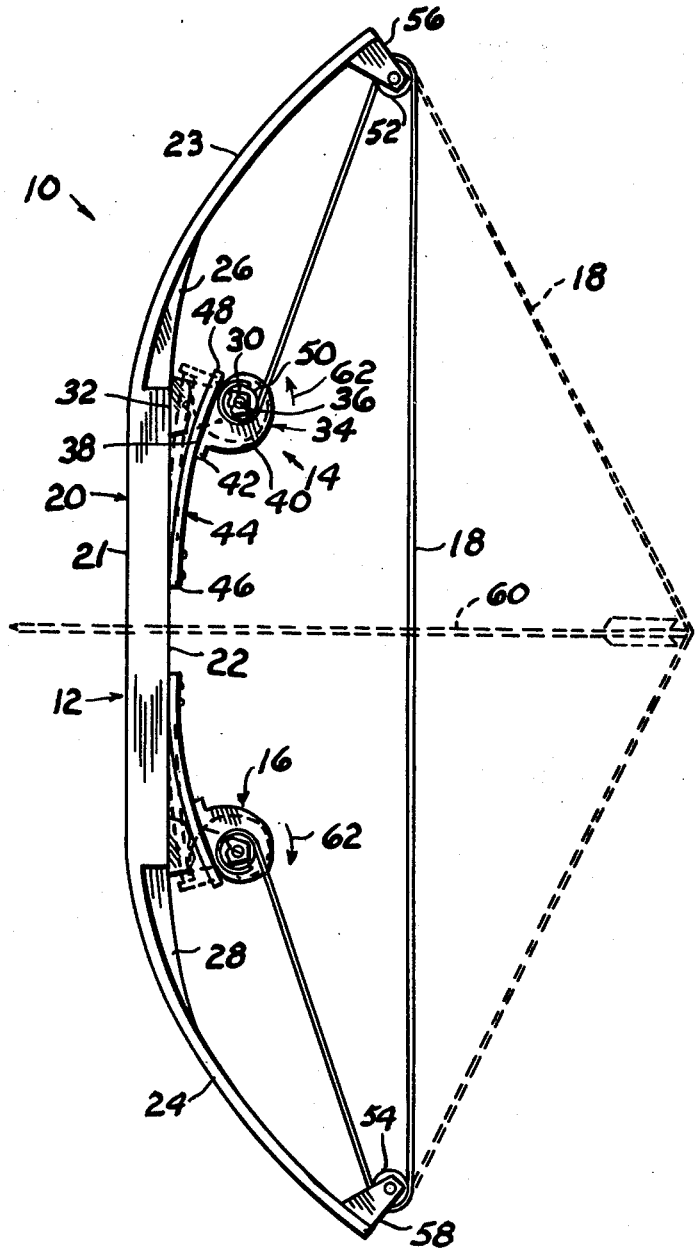
FIG. 1 is a side elevational view of the bow illustrating, by dotted lines, the maximum displacement of the bowstring and the relative position of the cams when the bowstring is at full draw; and, FIG. 2 is an elevational view of the right side of FIG. 1 with what portion of the bowstring extending between the end pulleys removed for clarity.
Figure 2:
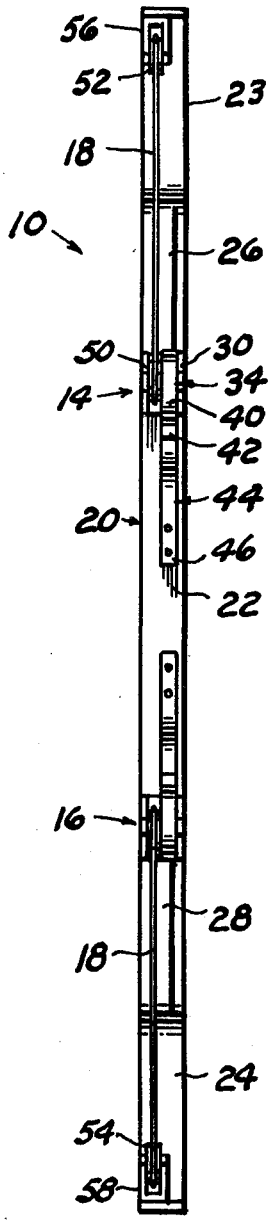

Like characters of reference designate like parts in those figures of the drawings in which they occur.

In the drawings:

The reference numeral 10 indicates the compound bow, as a whole, comprising a bow frame 12, cam means 14 and 16 and a bowstring 18.

The bow frame 12 includes an elongated central rigid handle portion 20 having a front face 21 and a rearward face 22 and having integral non-flexing upper and lower limbs 23 and 24 projecting from its respective ends and characterized by being arcuately curved rearwardly. The limbs 23 and 24 are reinforced against bending relative to the handle by integral gussets 26 and 28.

The cam means 14 and 16 are mounted at respective ends of the handle 20 and, being identical, only the cam means 14 will be described in detail. The cam means 14 comprises a generally U-shaped bracket 30 having its bight portion 32 flatly secured to an end portion of the handle 20. A disk-like eccentric cam 34 is journalled on a pin 36 by the legs of the bracket for angular rotation in the longitudinal plane of the handle. The cam is characterized by a generally flat surface 38 normally facing the handle rearward face 22 and merging at one end with an arcuate spiral-shaped cam surface 40 which terminates in a transverse outstanding stop 42 at the other end of the flat surface 38 for the purposes presently explained.

An elongated arcuately curved resilient member 44, such as a leaf spring, is rigidly secured longitudinally, at one end portion 46, to the central portion of the handle rearward face with its other end portion 48 curving toward and generally flatly contacting the cam flat surface 38. The cam 34 is further characterized by an integral cam pulley 50, on one side thereof concentric with the pin 36, around which one end portion of the bowstring 18 is entrained through a selected arc of its periphery and secured thereto. A pair of limb pulleys 52 and 54 are similarly mounted by U-shaped brackets 56 and 58 on the distal end portion of the respective bow limbs 23 and 24 in cooperative alignment with the cam pulleys. The respective end portions of the bowstring 18 is entrained over the pulleys 52 and 54.

Operation

In operation, the handle 20 is grasped by one hand of the archer while his other hand, holding an arrow or projectile 60, grasps the central portion of the bowstring 18 to draw the bow, as illustrated by dotted lines (FIG. 1). As the string is drawn, the cams 34 are rotated in the direction of the arrows 62 so that the cam surfaces 40, bearing against the spring means 44, forces the free end portions 48 of the spring means toward the respective ends of the handle 20 until the cam surface 40 reaches its maximum position of spring means displacement and full draw of the bowstring where the stops 42 simultaneously contact the free end of the respective spring means 44.

Upon release of the bowstring the spring means 44 rotates the cams 34 to the solid line position of FIG. 1 and propells the arrow toward the target.

Obviously the invention is susceptible to changes or alterations without defeating its practicability. Therefore, I do not wish to be confined to the preferred embodiment shown in the drawings and described herein.

I claim:

1. An archery bow comprising:

a handle portion having a front face, a rearward face and opposing end portions and having a pair of limbs projecting from its respective ends;

cam means including a disk-like cam having a cam surface mounted on the handle rearward face at its respective end portions for angular rotation parallel with the longitudinal plane of the handle;

resilient means secured to the rearward face of said handle portion and bearing against each said cam surface for resisting angular rotation of said cam and normally biasing said cam toward an at rest position;

pulley means including a limb pulley secured to the distal end portion of said limbs for connecting a bowstring thereto; and, a bowstring entrained over said limb pulleys and connected at its respective ends with said cams in a manner to angularly rotate said cams in response to drawing said bowstring from its at rest position.

2. The archery bow according to claim 1 in which each said cam means further includes:

a generally U-shaped bracket having its bight portion contacting the handle portion rearward surface and having rearwardly projecting bracket legs; and, a pin extending between said bracket legs and journalling said cam.

3. The archery bow according to claim 2 in which each said cam means further includes:

a cam pulley secured to said cam concentric with said pin, each respective end portion of said bowstring being entrained around an arc of the periphery of the respective said cam pulley.

4. The archery bow according to claim 3 in which said cam means further includes:

stop means on each said cam for contacting each said resilient means and stopping angular rotation of each said cam at full draw of said bowstring.

5. The archery bow according to claim 4 in which said resilient means comprises:

a pair of leaf springs arcuately curved rearwardly.

* * * * *